US009670613B2

(12) United States Patent
Ko et al.

(10) Patent No.: US 9,670,613 B2
(45) Date of Patent: Jun. 6, 2017

(54) GARMENT PROCESSING APPARATUS

(71) Applicant: LG ELECTRONICS INC., Seoul (KR)

(72) Inventors: Cheolsoo Ko, Seoul (KR); Woore Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 29 days.

(21) Appl. No.: 14/654,738

(22) PCT Filed: Jan. 3, 2014

(86) PCT No.: PCT/KR2014/000029

§ 371 (c)(1),
(2) Date: Jun. 22, 2015

(87) PCT Pub. No.: WO2014/115976

PCT Pub. Date: Jul. 31, 2014

(65) Prior Publication Data

US 2015/0345072 A1 Dec. 3, 2015

(30) Foreign Application Priority Data

Jan. 25, 2013 (KR) ..... 10-2013-0008500

(51) Int. Cl.
*D06F 58/12* (2006.01)
*D06F 58/28* (2006.01)
(Continued)

(52) U.S. Cl.
CPC ..... *D06F 58/28* (2013.01); *D06F 58/203* (2013.01); *D06F 58/206* (2013.01); *D06F 58/24* (2013.01);
(Continued)

(58) Field of Classification Search
CPC ..... F26B 21/00; F26B 21/06; D06F 58/00; D06F 58/12; D06F 58/20
(Continued)

(56) References Cited

U.S. PATENT DOCUMENTS 5,228,212 A * 7/1993 Turetta ..... D06F 58/28 34/493
7,325,333 B2 * 2/2008 Tadano ..... D06F 58/206 34/604
(Continued)

FOREIGN PATENT DOCUMENTS

CN 102268807 12/2011
CN EP 2778281 A1 * 9/2014 ..... D06F 58/24
(Continued)

OTHER PUBLICATIONS

International Search Report dated Apr. 23, 2014 issued in Application No. PCT/KR2014/000029 (with English translation).
(Continued)

*Primary Examiner* — Stephen M Gravini
(74) *Attorney, Agent, or Firm* — KED & Associates LLP

(57) ABSTRACT

The present invention relates to a garment processing apparatus comprising: a hot-air supply unit having a circulation flow path for directing the air drawn out from the interior of a garment receiving unit into the interior of the garment receiving unit, a heat exchange unit provided to the circulation flow path, for condensing and heating the air introduced into the circulation flow path, and a blower for circulating the air in the interior of the garment receiving unit through the circulation flow path; and a dryness detection unit having a flow rate detection means for measuring the amount of condensate water formed in the heat exchange unit, and a control section for determining the amount of
(Continued)

moisture contained in the laundry on the basis of the flow rate data provided by the flow rate detection means.

15 Claims, 6 Drawing Sheets

(51) Int. Cl.
*D06F 58/20* (2006.01)
*D06F 58/24* (2006.01)

(52) U.S. Cl.
CPC ..... *D06F 2058/287* (2013.01); *D06F 2058/2816* (2013.01); *D06F 2058/2832* (2013.01)

(58) Field of Classification Search
USPC ..... 34/413, 497, 601, 610; 68/5 C, 5 R, 19, 68/20; 8/139, 149, 159
See application file for complete search history.

(56) References Cited

U.S. PATENT DOCUMENTS 7,526,879 B2 * 5/2009 Bae ..... D06F 58/206 34/239
8,104,191 B2 * 1/2012 Ricklefs ..... D06F 58/203 34/474
8,112,904 B2 * 2/2012 Kono ..... D06F 25/00 34/201
8,544,187 B2 * 10/2013 Choi ..... D06F 58/28 34/407
8,572,862 B2 * 11/2013 TeGrotenhuis ..... F26B 23/005 165/164
8,615,895 B2 * 12/2013 Shin ..... D06F 58/22 34/606
8,627,581 B2 * 1/2014 Brown ..... D06F 58/02 34/603
8,869,421 B2 * 10/2014 Kim ..... D06F 25/00 34/381
2010/0126032 A1 5/2010 Kim et al.
2014/0366397 A1 * 12/2014 Wakizaka ..... D06F 58/206 34/524
2015/0292140 A1 * 10/2015 Coniguardi ..... D06F 58/02 34/108
2015/0345072 A1 * 12/2015 Ko ..... D06F 58/203 34/493
2016/0160429 A1 * 6/2016 Vian ..... D06F 58/28 34/443
2016/0201985 A1 * 7/2016 Lee ..... F26B 5/04 34/73

FOREIGN PATENT DOCUMENTS

DE WO 9629458 A1 * 9/1996 ..... A61L 2/07
EP 0 481 561 4/1992
JP 05146593 A * 6/1993
JP 2010-252896 A 11/2010
JP 2011-136075 A 7/2011
JP 2012-115297 A 6/2012
KR 10-2012-0088034 A 8/2012
KR WO 2014115976 A1 * 7/2014 ..... D06F 58/203
KR 20140095741 A * 8/2014 ..... D06F 58/203
KR 20140147026 A * 12/2014
KR EP 2949804 A1 * 12/2015 ..... D06F 58/203
WO WO 03/062517 7/2003
WO WO 03/074778 9/2003

OTHER PUBLICATIONS

Chinese Office Action dated May 3, 2016 issued in Application No. 201480004427.7 (with English Translation).
European Search Report dated Jun. 15, 2016 issued in Application No. 14743405.4.

* cited by examiner (a)

(b)

(a)

(b)

GARMENT PROCESSING APPARATUS

CROSS-REFERENCE TO RELATED PATENT APPLICATIONS

This application is a U.S. National Stage Application under 35 U.S.C. 5371 of PCT Application No. PCT/KR2014/000029, filed Jan. 3, 2014, which claims priority to Korean Patent Application No. 10-2013-0008500, filed Jan. 25, 2013, whose entire disclosures are hereby incorporated by reference.

TECHNICAL FIELD

The present invention relates to a garment processing apparatus.

BACKGROUND ART

Garment processing apparatuses (or Laundry treatment apparatuses) are home appliances capable of washing and/or drying laundry, and include a washing machine, a drying machine, and a combined drying and washing machine.

A laundry treatment apparatus capable of drying laundry is adapted to supply high temperature air (hot air), and may be divided into an exhaust type laundry treatment apparatus and a circulation type (condensation type) laundry treatment apparatus based on an air flow method.

A circulation type laundry treatment apparatus, which circulates interior air of a laundry accommodation unit in which laundry is stored, is configured to implement removal of moisture (dehumidification) of air discharged from the laundry accommodation unit and to heat and resupply the air into the laundry accommodation unit.

An exhaust type laundry treatment apparatus is configured to supply heated air into a laundry accommodation unit and to exhaust air discharged from the laundry accommodation unit to the outside of the laundry treatment apparatus (rather than resupplying the air into the laundry accommodation unit).

Meanwhile, a hot air supply unit used in a conventional laundry treatment apparatus includes a blower configured to discharge air from a laundry accommodation unit and a heat exchanger configured to heat air moved by the blower.

That is, in the conventional laundry treatment apparatus, in terms of air flow direction, the blower is located in front of the heat exchanger, such that air discharged from the laundry accommodation unit passes through the blower and the heat exchanger in sequence, and thereafter is resupplied into the laundry accommodation unit.

However, the above-described conventional laundry treatment apparatus, in which the blower is located in front of the heat exchanger, has a disadvantage in that air discharged from the laundry accommodation unit passes through only a portion of the heat exchanger. Due to this disadvantage (i.e. low heat exchange efficiency), the conventional laundry treatment apparatus problematically needs to supply unnecessarily excessive amount of energy to the heat exchanger.

In addition, the conventional laundry treatment apparatus is adapted to determine dryness of laundry using the temperature of air discharged from the laundry accommodation unit (i.e. the temperature of air prior to passing through the heat exchanger) and the temperature of air to be supplied into the laundry accommodation unit after passing through the heat exchanger.

The above-described dryness determination method, however, has difficulty in accurately determining dryness of laundry because a temperature sensor cannot accurately measure the temperature of air discharged from the laundry accommodation unit if impurities (e.g., lint) contained in the air discharged from the laundry accommodation unit are accumulated on the temperature sensor.

DISCLOSURE

Technical Problem

One object of the present invention is to provide a laundry treatment apparatus which may accurately determine dryness of laundry based on the quantity of condensed water generated during drying of laundry.

Another object of the present invention is to provide a laundry treatment apparatus which may accurately determine dryness of laundry by maximally preventing impurities contained in air discharged from a laundry accommodation unit from being accumulated on a temperature sensor.

Another object of the present invention is to provide a laundry treatment apparatus which may achieve high heat exchange efficiency by allowing air moved by a blower to pass through the overall region of a heat exchanger.

A further object of the present invention is to provide a laundry treatment apparatus which may ensure automated cleaning of a filter unit that serves to filter air to be supplied into a heat exchanger.

Technical Solution

In accordance with one aspect of the present invention, there is provided a laundry treatment apparatus including a cabinet defining an external appearance of the apparatus, the cabinet having a laundry opening, a laundry accommodation unit placed within the cabinet and configured to store laundry introduced through the laundry opening, a hot air supply unit including a circulation path arranged to guide air discharged from the laundry accommodation unit and resupply the air into the laundry accommodation unit, a heat exchanger installed to the circulation path to implement condensation and heating of the air introduced into the circulation path, and a blower configured to circulate the interior air of the laundry accommodation unit through the circulation path, and a dryness sensing unit including a flow rate sensing device configured to measure the quantity of condensed water generated in the heat exchanger and a controller configured to determine the quantity of moisture contained in the laundry based on flow rate data provided by the flow rate sensing device.

The controller may determine the quantity of moisture contained in the laundry by comparing the quantity of condensed water generated in the heat exchanger per unit time with a predetermined reference value.

The controller may determine the quantity of moisture contained in the laundry by comparing the total quantity of condensed water generated in the heat exchanger with a predetermined reference value.

The dryness sensing unit may further include a condensed water pipe connected to the circulation path to discharge the condensed water generated in the heat exchanger to the outside of the circulation path.

The laundry accommodation unit may include a tub placed within the cabinet and configured to store wash water therein, and a drum rotatably placed within the tub and configured to store laundry introduced through the laundry opening, and the circulation path may be configured such that the interior air of the tub is discharged into the circulation path and then is resupplied into the tub.

The heat exchanger may include an evaporator configured to cool air introduced into the circulation path via evaporation of refrigerant, the evaporator being located in the circulation path, a condenser configured to heat the air passed through the evaporator via condensation of the refrigerant, the condenser being located in the circulation path, and a compressor installed at the outside of the circulation path to enable circulation of the refrigerant through the evaporator and the condenser.

The laundry treatment apparatus may further include a drain unit configured to discharge wash water stored in the tub, and the condensed water pipe may be installed to connect the circulation path and the drain unit to each other.

The laundry treatment apparatus may further include a drain unit including a drain pump and a drain pipe configured to guide wash water stored in the tub to the drain pump, and the condensed water pipe may be installed to connect the circulation path and the drain pipe to each other.

One end of the condensed water pipe connected to the circulation path may be located between the evaporator and the condenser.

The circulation path may include a suction duct fixed at a rear portion of a circumferential surface of the tub, through which the interior air of the tub is discharged, a connection duct installed to connect the suction duct and the blower to each other, the evaporator and the condenser being fixed to the connection duct between the suction duct and the blower, and a discharge duct configured to supply the air discharged from the blower into the tub, the discharge duct being fixed to a front surface of the tub facing the laundry opening.

The connection duct may include a sump provided below the evaporator such that the condensed water generated in the evaporator is stored in the sump, and the condensed water pipe may be configured to discharge the condensed water stored in the sump to the outside of the connection duct.

The sump may be defined by a plurality of support ribs protruding from the connection duct to support the bottom of the evaporator.

The dryness sensing unit may further include a condensed water storage container in which the condensed water discharged from the condensed water pipe is stored, and the flow rate sensing device may include a water level sensor configured to measure the level of condensed water stored in the condensed water storage container.

The connection duct may have a through-hole, through which the condensed water generated in the evaporator is discharged to the outside of the connection duct, and the condensed water storage container may be coupled to the connection duct to store the condensed water discharged from the through-hole.

In accordance with another aspect of the present invention, there is provided a control method of a laundry treatment apparatus, the laundry treatment apparatus including a laundry accommodation unit in which laundry is stored, a circulation path arranged to guide air discharged from the laundry accommodation unit and resupply the air into the laundry accommodation unit, a heat exchanger installed to the circulation path to implement condensation and heating of the air introduced into the circulation path, a blower configured to circulate the interior air of the laundry accommodation unit through the circulation path, and a flow rate sensing device configured to measure the quantity of condensed water generated in the heat exchanger, the control method including operating the heat exchanger and the blower, measuring the quantity of condensed water generated in the heat exchanger via the flow rate sensing device, and stopping operation of the heat exchanger and the blower based on a result of comparing flow rate data provided by the flow rate sensing device with a predetermined reference value.

Stopping operation of the heat exchanger and the blower may be conducted when the generation quantity of condensed water per unit time, measured by the flow rate sensing device, is equal to or less than the predetermined reference value.

Stopping operation of the heat exchanger and the blower may be conducted when the total quantity of condensed water generated in the heat exchanger, measured by the flow rate sensing device, is equal to or greater than the predetermined reference value.

Advantageous Effects

The present invention has the effect of providing a laundry treatment apparatus capable of accurately determining dryness of laundry based on the quantity of condensed water generated during drying of laundry.

Further, the present invention has the effect of providing a laundry treatment apparatus capable of accurately determining dryness of laundry by maximally preventing impurities contained in air discharged from a laundry accommodation unit from being accumulated on a temperature sensor.

Furthermore, the present invention has the effect of providing a laundry treatment apparatus capable of achieving high heat exchange efficiency by allowing air moved by a blower to pass through the overall region of a heat exchanger.

In addition, the present invention has the effect of providing a laundry treatment apparatus capable of ensuring automated cleaning of a filter unit that serves to filter air to be supplied into a heat exchanger.

DESCRIPTION OF DRAWINGS

The accompanying drawings, which are included to provide a further understanding of the invention, illustrate embodiments of the invention and together with the description serve to explain the principle of the invention.

In the drawings.

BEST MODE

Figure 1:
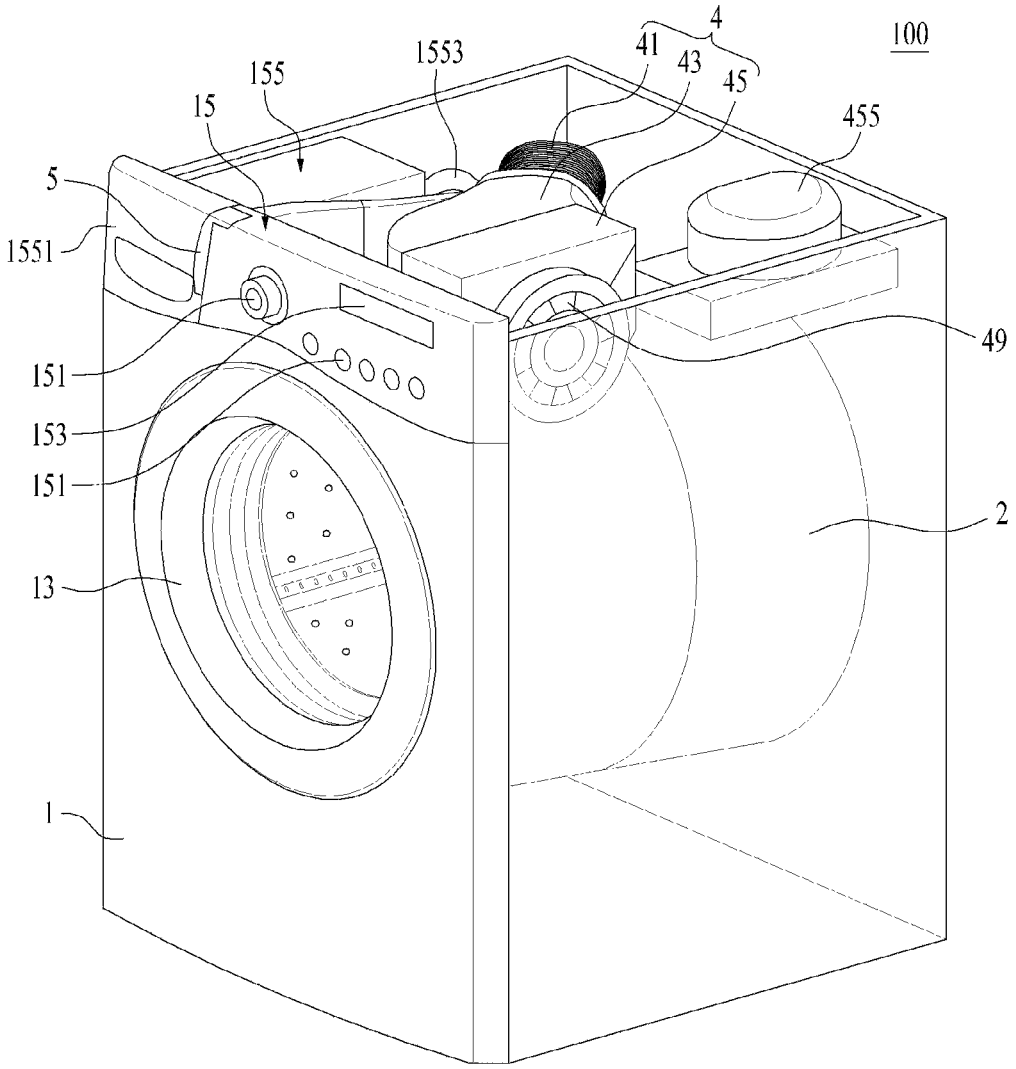
FIG. 1 is a perspective view of a laundry treatment apparatus according to the present invention.

Hereinafter, exemplarily embodiments of the present invention will be described in detail with reference to the accompanying drawings. A configuration and a control method of an apparatus that will be described hereinafter are provided for explanation of the exemplarily embodiments of the present invention and are not intended to limit the technical scope of the present invention. The same reference numerals of the entire specification designate the same constituent elements.

Figure 2:
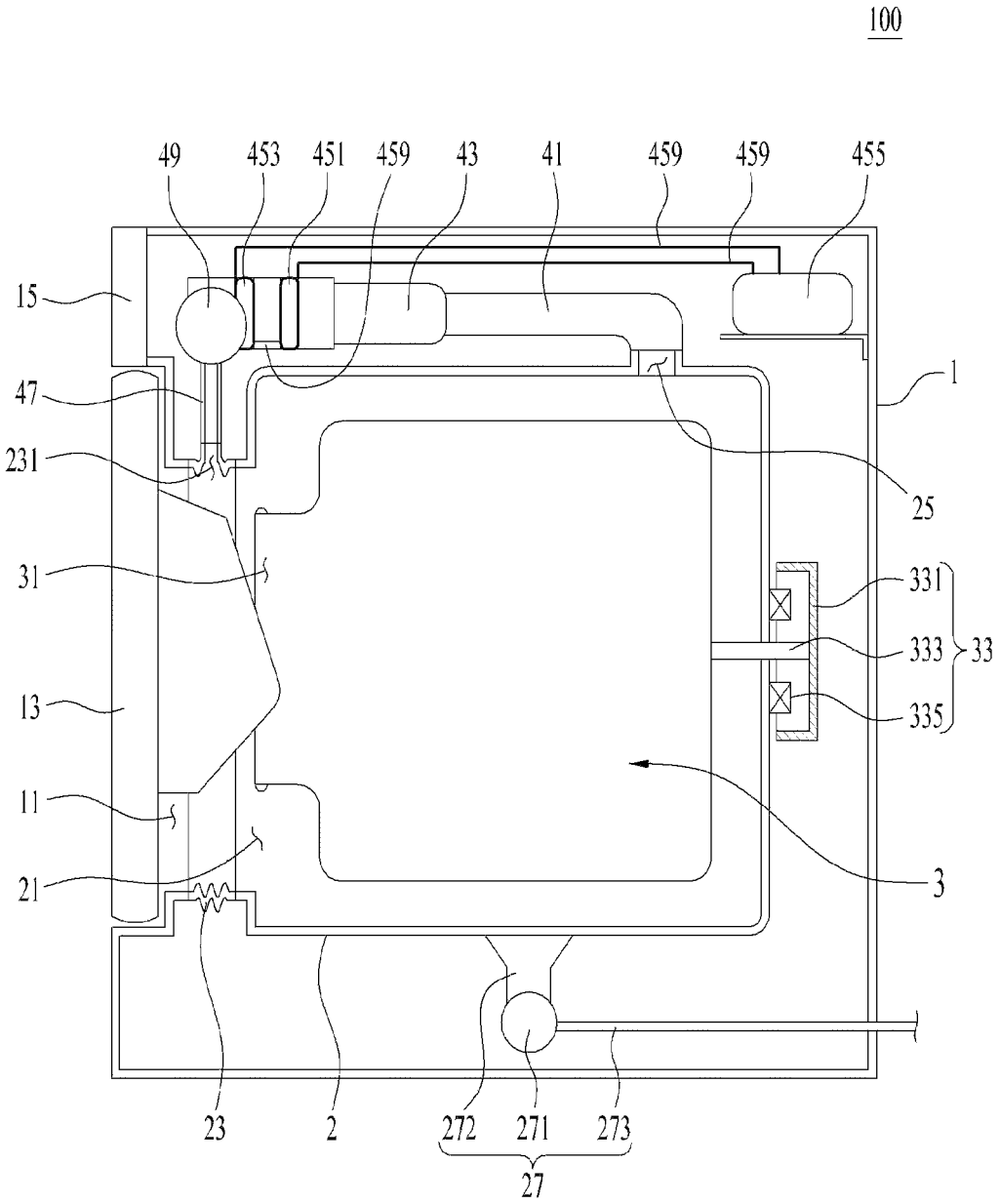
FIG. 2 is a sectional view of the laundry treatment apparatus according to the present invention.

As exemplarily shown in FIGS. 1 and 2, a laundry treatment apparatus of the present invention, designated by reference numeral 100, includes a cabinet 1 defining an external appearance of the apparatus 100, a laundry accommodation unit placed within the cabinet 1 and configured to store laundry therein, and a hot air supply unit 4 configured to supply hot air into the laundry accommodation unit.

The cabinet 1 has a laundry opening 11 through which laundry is introduced or removed, and a door 13 rotatably coupled to the cabinet 1 to open or close the laundry opening 11.

A control panel 15 is installed to the cabinet 1 at a position above the laundry opening 11. The control panel 15 is provided with at least one of an input unit 151 for input of a control instruction to operate the laundry treatment apparatus 100 and a display unit 153 for display of control details of the laundry treatment apparatus 100.

The input unit 151 provided at the control panel 15 takes the form of an array of buttons or a rotary knob, and serves to input a control instruction to a controller (not shown). Here, the control instruction is related to washing or drying programs preset in the laundry treatment apparatus 100 (e.g., a washing course or a drying course), washing time, the quantity of wash water, the supply time of hot air, and the like.

The display unit 153 serves to display, for example, the control instruction (e.g., a course name) input via the input unit 151, and information (e.g., residual time) given as the laundry treatment apparatus 100 is operated in response to the input control instruction.

If the laundry treatment apparatus 100 of the present invention is a drying machine having only a function of drying laundry, the laundry accommodation unit may include only a drum 3 rotatably placed within the cabinet 1.

On the other hand, if the laundry treatment apparatus 100 of the present invention is an apparatus capable of implementing both drying and washing of laundry, as exemplarily shown in FIG. 2, the laundry accommodation unit may be comprised of a tub 2 placed within the cabinet 1 and configured to store wash water therein and the drum 3 rotatably placed within the tub 2 and configured to store laundry therein.

For convenience of explanation, the following description will be based on the laundry accommodation unit including both the tub 2 and the drum 3.

As exemplarily shown in FIG. 2, the tub 2 has a hollow cylindrical shape and is fixed within the cabinet 1. The tub 2 has a tub opening 21 perforated in a front surface thereof to face the laundry opening 11 for introduction and removal of laundry.

A gasket 23 is interposed between the tub opening 21 and the laundry opening 11. The gasket 23 serves not only to prevent wash water stored in the tub 2 from leaking from the tub 2, but also to prevent vibration of the tub 2 generated during rotation of the drum 3 from being transferred to the cabinet 1.

The tub 2 may be arranged parallel to the ground, on which the cabinet 1 is supported, as exemplarily shown in the drawing, or may be tilted by a prescribed angle with respect to the ground. Note that in the case in which the tub 2 is tilted by a prescribed angle with respect to the ground, an inclination angle of the tub 2 may be less than 90 degrees.

The tub 2 further has an air discharge hole 25 perforated in an upper portion of a circumferential surface thereof for discharge of air from the tub 2. A drain unit 27 for discharge of wash water stored in the tub 2 is installed to the bottom of the tub 2.

Figure 3:
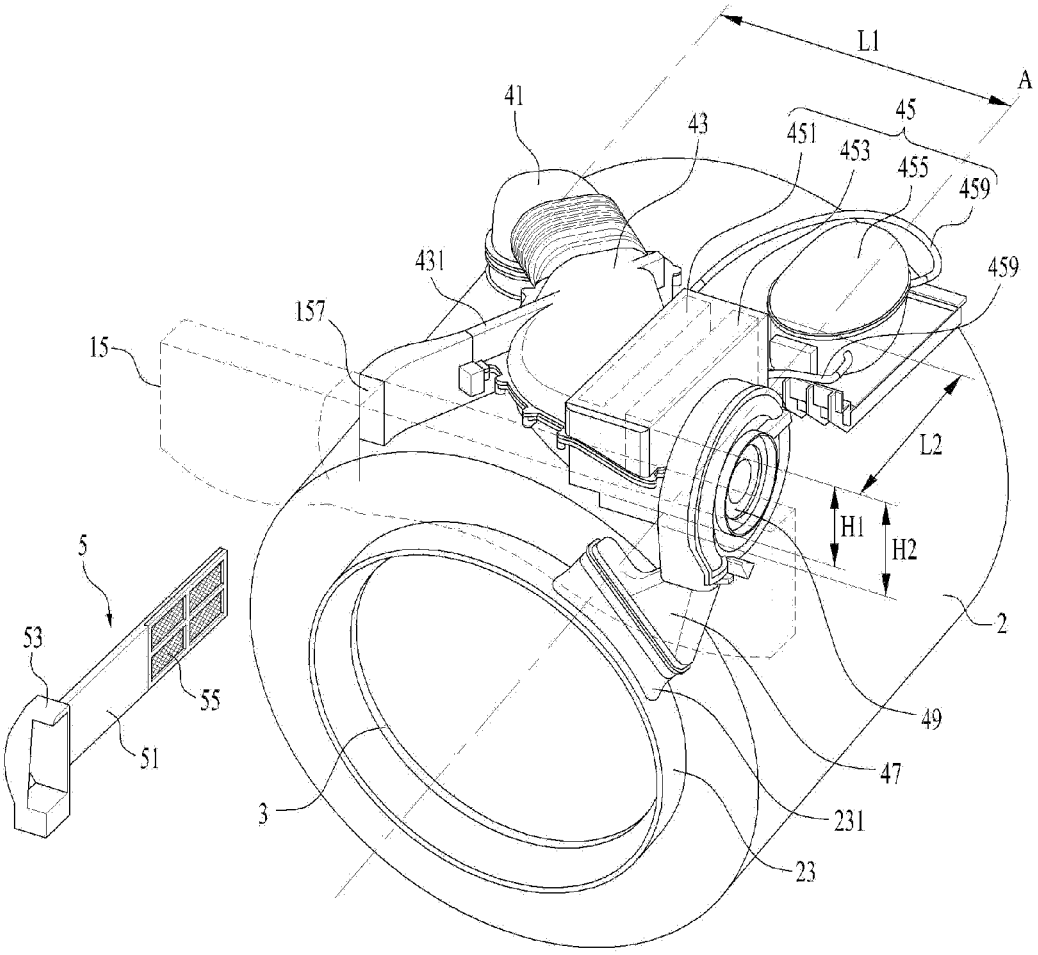
FIG. 3 is a view showing a hot air supply unit and a filter unit included in the laundry treatment apparatus according to present invention.

The air discharge hole 25 may be formed in a longitudinal direction of the tub 2 at a position spaced apart from an imaginary center line A of the tub 2 by a predetermined distance L1 (see FIG. 3).

This serves to allow the interior air of the tub 2 to be easily discharged from the tub 2 through the air discharge hole 25 during rotation of the drum 3.

The drain unit 27 may include drain pipes 272 and 273 providing communication between the interior of the tub 2 and the outside of the cabinet 1, and a drain pump 271 installed to discharge wash water stored in the tub 2 through the drain pipe 273.

The drum 3 has a hollow cylindrical shape and is placed within the tub 2. The drum 3 may be rotated within the tub 2 by a motor 33 installed to an outer rear surface of the tub 2.

The motor 33 may include a stator 335 fixed to the rear surface of the tub 2, a rotor 331 configured to be rotated via electromagnetic interaction with the stator 335, and a rotating shaft 333 penetrating the rear surface of the tub 2 to connect the rotor 331 and a rear surface of the drum 3 to each other.

Meanwhile, the drum 3 has a drum opening 31 communicating with the laundry opening 11 and the tub opening 21. Thus, a user may introduce laundry into the drum 3 through the laundry opening 11, and remove laundry stored in the drum 3 from the cabinet 1.

If the laundry treatment apparatus 100 of the present invention is capable of implementing both drying and washing of laundry, a detergent supply unit 155 may be additionally installed within the cabinet 1 to store detergent to be supplied into the tub 2.

As exemplarily shown in FIG. 1, the detergent supply unit 155 may include a reservoir 1551 in the form of a drawer that may be withdrawn from the cabinet 1, and a detergent supply pipe 1553 configured to guide detergent stored in the reservoir 1551 into the tub 2.

Water is supplied into the reservoir 1551 from an external water supply source (not shown) of the laundry treatment apparatus 100. Thus, once water has been supplied into the reservoir 1551 via the water supply source (not shown), detergent stored in the reservoir 1551 may be supplied, along with the water, into the tub 2 through the detergent supply pipe 1553.

The detergent supply unit 155 may be located above the laundry opening 11 at a position parallel to the control panel 15.

As exemplarily shown in FIG. 3, the hot air supply unit 4 includes a circulation path 41, 43 and 47 configured to guide air discharged from the tub 2 to the front surface of the tub 2 (i.e. one surface of the tub 2 that faces the laundry opening 11), a heat exchanger 45 placed within the circulation path, and a blower 49 located between the heat exchanger 45 and the front surface of the tub 2 to circulate the interior air of the tub 2.

The circulation path may be comprised of a suction duct 41 fitted into the air discharge hole 25 of the tub 2, a connection duct 43 configured to connect the suction duct 41 and the blower 49 to each other, the heat exchanger 45 being secured to the connection duct 43, and a discharge duct 47 configured to connect the blower 49 and the gasket 23 to each other.

The suction duct 41 is a path, into which the interior air of the tub 2 is discharged through the air discharge hole 25 perforated in an upper rear portion of the circumferential surface of the tub 2. The suction duct 41 may be formed of a vibration insulating material (e.g., rubber).

This serves to prevent vibration of the tub 2 generated during rotation of the drum 3 from being transferred to the connection duct 43 and the heat exchanger 45 through the suction duct 41.

To more efficiently prevent vibration of the tub 2 from being transferred to the connection duct 43 and the heat exchanger 45, the suction duct 41 may have bellows. In this case, the bellows may be formed at the entire suction duct 41, or may be formed at a portion of the suction duct 41 (i.e. a coupling portion with the connection duct 43).

The heat exchanger 45 may be a heat pump. In this case, the heat exchanger 45 is comprised of an evaporator 451, a condenser 453, a compressor 455, and an expander (i.e. expansion vale (not shown)). The evaporator 451 and the condenser 453 may be fixed within the connection duct 43, whereas the compressor 455 and the expander may be mounted at the outside of the connection duct 43.

The compressor 455, the evaporator 451, the condenser 453, and the expander (not shown) are connected to each other via a refrigerant pipe 459, and circulation of refrigerant is realized by the compressor 455.

In the evaporator 451, refrigerant is evaporated by absorbing heat from air introduced into the connection duct 43. Thereby, the evaporator 451 serves to implement cooling of the air as well as removal of moisture contained in the air (i.e. dehumidification and condensation of the air).

As the interior air of the connection duct 43 is condensed while passing through the evaporator 451 as described above, condensed water remains in the connection duct 43.

Therefore, there is a risk of the condensed water remaining in the connection duct 43 being unintentionally directed to laundry during drying. According to the present invention, the laundry treatment apparatus 100 may further include a device to discharge the condensed water from the connection duct 43. This device will be described in detail later.

In the condenser 453, the refrigerant is condensed. As heat generated during condensation of the refrigerant is transferred to air passing through the condenser 453, the condenser 453 serves to heat the air passed through the evaporator 451.

Note that the circulation path 41, 43 and 47, as exemplarily shown in FIG. 3, may be arranged in a diagonal direction of an upper portion of the tub 2. In this case, the compressor 455 may be located in a space between the circulation path 41, 43 and 47 and the cabinet 1 among a space above the tub 2. This contributes to efficient utilization of a space above the circumferential surface of the tub 2, thereby preventing increase in the height or volume of the laundry treatment apparatus 100.

The discharge duct 47 serves to guide the air discharged from the connection duct 43 into the tub 2 through the blower 49. One end of the discharge duct 47 is fixed to the blower 49 and the other end of the discharge duct 47 is connected to a duct connection hole 231 formed in the gasket 23.

To prevent vibration of the tub 2 generated during rotation of the drum 3 from being transferred to the blower 49 or the connection duct 43 through the discharge duct 47, at least one of the gasket 23 and the discharge duct 47 may be formed of a vibration insulating material (or an elastic material).

The blower 49 is located between the heat exchanger 45 and the discharge duct 47. Thus, the blower 49 according to the present invention causes air to pass through the heat exchanger 45 by generating negative pressure at the rear side of the heat exchanger 45 (toward the discharge duct 47), rather than generating positive pressure at the front side of the heat exchanger 45 (toward the suction duct 41).

If air passes through the blower 49 and the heat exchanger 45 in sequence and thereafter is supplied into the tub 2 (i.e. if the blower 49 causes the air to pass through the heat exchanger 45 by generating positive pressure at the front side of the heat exchanger 45), some of the interior air of the connection duct 43 may be easily moved to the heat exchanger 45, but some of the air may not be easily moved to the heat exchanger 45.

That is, although most of the air discharged from the blower 49 is easily moved to the heat exchanger 45, some of the air discharged from the blower 49 may have difficulty in being rapidly moved to the heat exchanger 45 according to the shape of the connection duct 43 or the configuration of the blower 49.

For this reason, in the case of a configuration in which the blower 49 is located in front of the heat exchanger 45 to forcibly blow air toward the heat exchanger 45 (to generate positive pressure at the front side of the heat exchanger 45), the flow rate of air per cross section of the connection duct 43 may be inconstant according to a position of the connection duct 43, which may result in deterioration of heat exchange efficiency.

However, according to the laundry treatment apparatus 100 of the present invention, the above-described problem may be solved as the blower 49 is located between the heat exchanger 45 and the discharge duct 47 (to allow air to pass through the heat exchanger 45 and the blower 49 in sequence).

When the blower 49 is located between the heat exchanger 45 and the discharge duct 47, negative pressure is generated at the rear side of the heat exchanger 45. Such generation of negative pressure at the rear side of the heat exchanger 45 ensures that the air being moved to the heat exchanger 45 through the connection duct 43 has a constant flow rate throughout the cross section of the connection duct 43. Accordingly, the laundry treatment apparatus 100 of the present invention may enhance heat exchange efficiency between the air and the heat exchanger 45 (i.e. achieve high drying efficiency).

According to the present invention, the connection duct 43 is disposed on an upper portion of the circumferential surface of the tub 2, and therefore may have difference between the size of a space in which the evaporator 451 is located and the size of a space in which the condenser 453 is located. That is, a height H1 of the connection duct 43 with regard to an installation space of the evaporator 451 may be less than a height H2 of the connection duct 43 with regard to an installation space of the condenser 453.

If the connection duct 43 arranged in a longitudinal direction of the tub 2 has a constant width L2, due to the above-described difference between the height H1 of the installation space of the evaporator 451 and the height H2 of the installation space of the condenser 453, heat exchange capacity of any one component may limit heat exchange capacity of the other component.

To prevent the above-described problem, an area ratio of the evaporator 451 to the condenser 453 according to the present invention may be within a range of 1:1.3 to 1:1.6.

According to the present invention, the laundry treatment apparatus 100 may further include a filter unit 5, which serves to filter the air discharged from the tub 2 to prevent impurities, such as lint, from being accumulated in the heat exchanger 45.

As exemplarily shown in FIGS. 1 and 3, the filter unit 5 may be separably coupled to the connection duct 43 by passing through the cabinet 1.

To this end, the connection duct 43 may be provided with a filter guide 431 to guide movement of the filter unit 5, and the cabinet 1 may be provided with a filter separation/coupling passage 157 through which the filter unit 5 passes.

The filter guide 431 serves to communicate the interior of the connection duct 43 with the filter separation/coupling passage 157. More specifically, the filter guide 431 may be comprised of a section that protrudes from an outer circumferential surface of the connection duct 43 and is connected to the filter separation/coupling passage 157, and a section that is located inside the connection duct 43 and configured to receive only an edge of the filter unit 5.

If the laundry treatment apparatus 100 of the present invention does not include the detergent supply unit 155, the filter separation/coupling passage 157 may be formed to penetrate the cabinet 1 or to penetrate the control panel 15.

On the other hand, if the laundry treatment apparatus 100 of the present invention includes the detergent supply unit 155, the filter separation/coupling passage 157 may be formed to penetrate the cabinet 1 in a space between the control panel 15 and the detergent supply unit 155 located above the laundry opening 11.

Moreover, the filter separation/coupling passage 157 may be located above the laundry opening 11. This has the effect of allowing the user to separate the filter unit 5 from the laundry treatment apparatus 100 by less bending at the waist than the case in which the filter unit 5 is located below the laundry opening 11, which may result in enhanced user convenience.

The filter guide 431 is installed to connect the filter separation/coupling passage 157 and the connection duct 43 to each other, such that the filter unit 5 inserted into the filter separation/coupling passage 157 is located between the suction duct 41 and the evaporator 451.

The above-described filter unit 5 may include a body 51 and a filter 55 installed to the body 51 to filter air.

A handle 53 may further be installed to the body 51. The handle 53 is seated in the filter separation/coupling passage 157 and serves to assist the user in easily withdrawing or inserting the filter unit 5 from or into the cabinet 1.

When the filter unit 5 is inserted into the cabinet 1, the body 51 is located in the filter guide 431 and the filter 55 is located inside the connection duct 43 (between the heat exchanger 45 and the suction duct 41).

The body 51 may be formed of an elastic material. This serves to ensure that the filter 55 may be coupled to or separated from the connection duct 43 if the filter separation/coupling passage 157 and the connection duct 43 are not arranged in a straight line perpendicular to the front surface of the cabinet 1.

That is, as exemplarily shown in FIG. 3, in the case in which the circulation path 41, 43 and 47 is arranged in a diagonal direction of the upper portion of the tub 2 (i.e. the connection duct 43 being located near the center of the upper portion of the tub 2) and the filter separation/coupling passage 157 is located in a lateral position of the front surface of the cabinet 1 (i.e. the filter separation/coupling passage 157 being spaced apart from the center of the upper portion of the tub 2), forming the body 51 of an elastic material may be necessary to allow the filter 55 to be easily moved into the connection duct 43.

According to the present invention, the laundry treatment apparatus 100 may further include a dryness sensing unit 6, which serves to discharge condensed water from the connection duct 43 and measure the quantity of condensed water discharged from the connection duct 43 (i.e. the quantity of condensed water generated in the evaporator 451 of the heat exchanger 45), thereby determining the quantity of wash water contained in laundry (i.e. dryness of laundry).

The dryness sensing unit 6 may be formed in various shapes so long as it can measure the quantity of condensed water generated in the evaporator 451. The configuration as shown in FIG. 4 or FIG. 5 may be one example.

Figure 4:
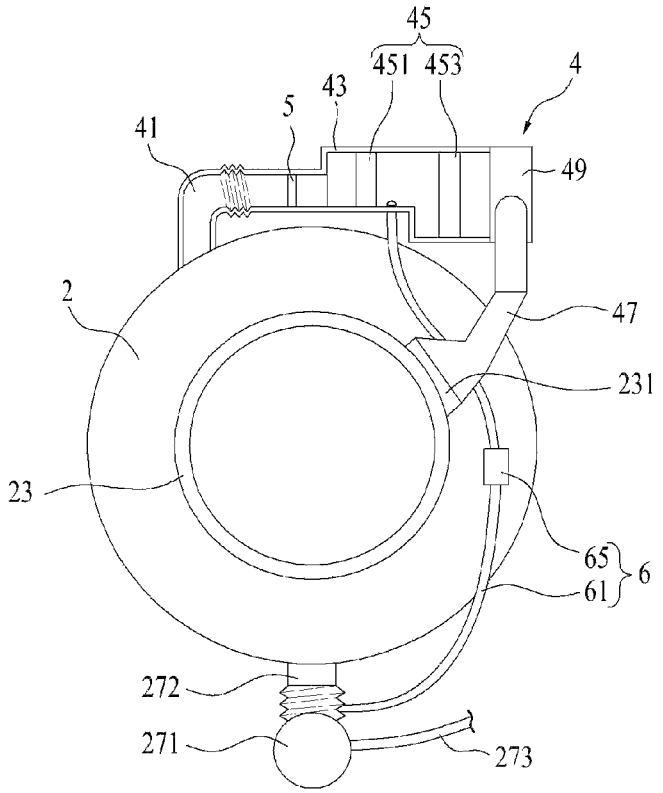
FIG. 4 is a view showing one example of a dryness sensing unit included in the laundry treatment apparatus according to present invention.
Figure 4:
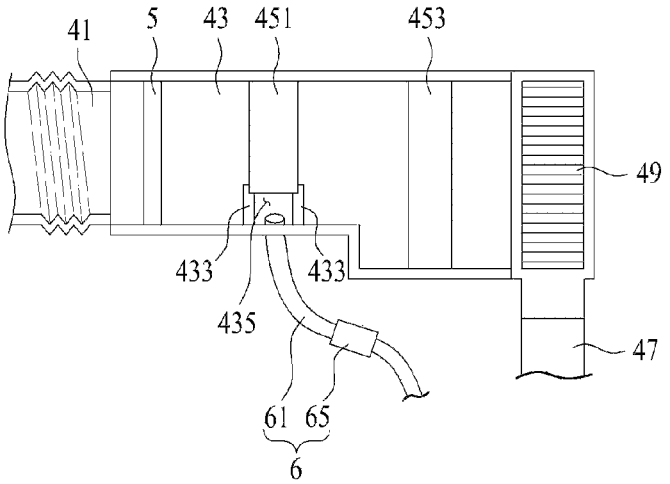
Figure 5:
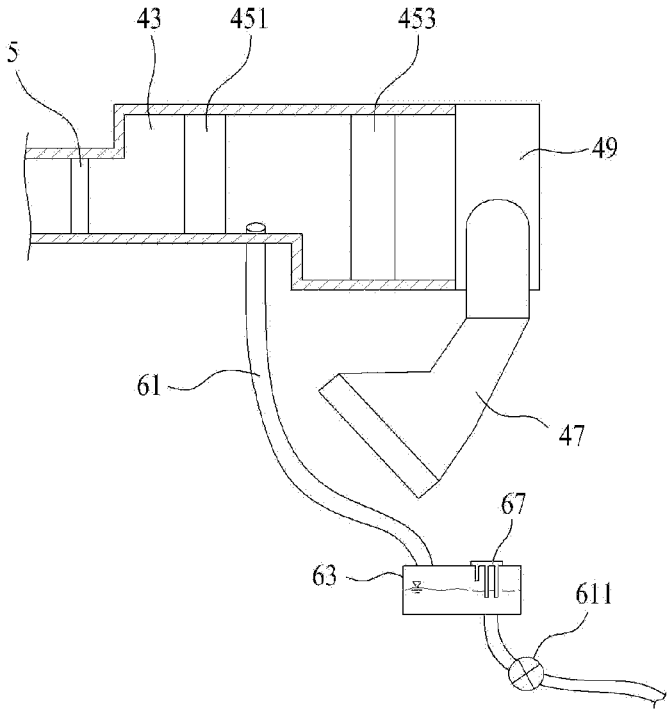
FIG. 5 is a view showing another embodiment of the dryness sensing unit included in the laundry treatment apparatus according to present invention.
Figure 5:
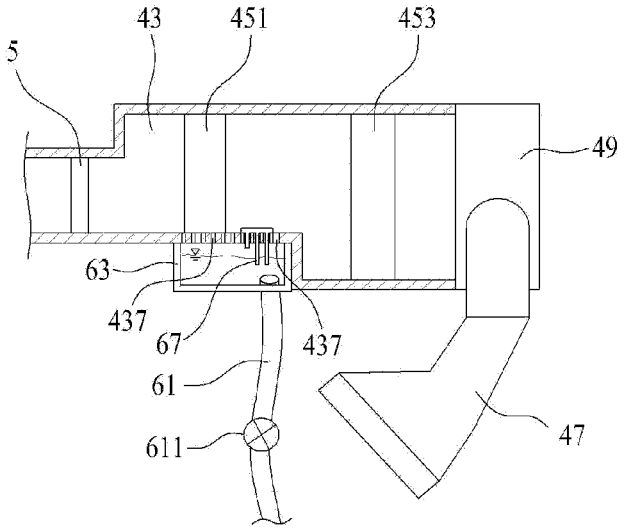

That is, as exemplarily shown in FIG. 4, the dryness sensing unit 6 may include a condensed water pipe 61 through which condensed water generated in the evaporator 451 is discharged outward from the connection duct 43, a flow rate sensing device which measures the quantity of condensed water discharged through the condensed water pipe 61, and a dryness controller (not shown) which determines the quantity of moisture contained in laundry (i.e. dryness of laundry) based on data regarding the quantity of condensed water (flow rate data) provided by the flow rate sensing device.

The condensed water pipe 61 may be installed to connect the connection duct 43 and the drain unit 27 to each other as exemplarily shown in FIG. 4. Alternatively, the condensed water pipe 61 may be installed to communicate the interior of the connection duct 43 with the outside of the cabinet 1.

Note that, when the drain unit 27 and the connection duct 43 are connected to each other via the condensed water pipe 61 as exemplarily shown in FIG. 4, condensed water remaining in the connection duct 43 as well as wash water stored in the tub 2 may be discharged through the drain pump 271 and the drain pipe 273 of the drain unit 27, which may realize a simplified configuration of the laundry treatment apparatus 100 and reduce manufacturing costs.

The drain unit 27, as described above, may include a first drain pipe 272 installed to connect the drain pump 271 and the tub 2 to each other, and a second drain pipe 273 installed to communicate the drain pump 271 with the outside of the cabinet 1. In this case, one end of the condensed water pipe 61 may be connected to the first drain pipe 272 or the second drain pipe 273, and the other end of the condensed water pipe 61 may be connected to the connection duct 43 between the evaporator 451 and the condenser 453.

The flow rate sensing device may be formed in various shapes so long as it can measure the quantity of condensed water discharged through the condensed water pipe 61 or the quantity of condensed water remaining in the connection duct 43. FIG. 4(*a*) shows, by one example of the flow rate sensing device, a flow meter 65, which is installed to the condensed water pipe 61 and serves to measure the generation quantity of condensed water per unit time or the total quantity of condensed water generated in the evaporator 451 for a prescribed time.

Despite the presence of the condensed water pipe 61, there is a risk of condensed water, generated while the air discharged from the tub 2 is being cooled via the evaporator 451, being introduced into the tub 2 through the suction duct 41 or the discharge duct 47 and directed to laundry inside the drum 3.

For this reason, as exemplarily shown in FIG. 4(*b*), the connection duct 43 may further be provided with a sump 435, which is located below the evaporator 451 to prevent the condensed water from being moved to the tub 2.

The sump 435 may be constructed by a plurality of evaporator support ribs 433 protruding from a bottom surface of the connection duct 43 to support a lower surface of the evaporator 451.

In this case, a pair of evaporator support ribs 433 may be arranged to face each other in a width direction L2 of the connection duct 43, in order to prevent condensed water introduced into the sump 435 from being moved to the condenser 453 or the suction duct 41. The condensed water pipe 61 may be connected to the connection duct 43 through the sump 435.

If the laundry treatment apparatus 100 of the present invention begins drying of laundry (a drying cycle), a controller (not shown) operates the blower 49 and the heat exchanger 45.

The interior air of the tub 2 is moved into the connection duct 43 through the suction duct 41 via operation of the blower 49. In turn, the air introduced into the connection duct 43 is subjected to dehumidification and heating while passing through the evaporator 451 and the condenser 453 in sequence.

The dehumidified and heated air passes through the blower 49, and thereafter is resupplied into the tub 2 through the discharge duct 47. Then, the air introduced into the tub 2 will exchange heat with laundry accommodated in the drum 3, and thereafter be moved into the suction duct 41 through the air discharge hole 25.

Meanwhile, the air introduced into the connection duct 43 is cooled while passing through the evaporator 451. In this cooling course, condensed water is generated.

The condensed water generated in the evaporator 451 is discharged from the connection duct 43 through the condensed water pipe 61, and the flow rate sensing device, such as, e.g., the flow meter 65 measures the total quantity of condensed water discharged from the condensed water pipe 61 or the quantity of condensed water discharged from the condensed water pipe 61 per unit time.

Flow rate data measured by the flow rate sensing device 65 is transmitted to the dryness controller (not shown). The dryness controller (not shown) determines the quantity of moisture contained in laundry (i.e. dryness of laundry) by comparing a predetermined reference value with the flow rate data measured by the flow rate sensing device 65.

If the flow rate data measured by the flow rate sensing device 65 is the total quantity of condensed water generated in the evaporator 451, the reference value may be set to the (experimentally measured) total quantity of condensed water generated in the evaporator 451 until laundry reaches target dryness on a per laundry quantity basis.

During the drying cycle, the total quantity of condensed water generated in the evaporator 451 will increase as time has passed, but the total quantity of moisture discharged from laundry based on target dryness of laundry on a per laundry quantity basis may be within a prescribed range. Therefore, the dryness controller (not shown) may determine dryness of laundry by comparing the total quantity of condensed water provided by the flow rate sensing device 65 with the total quantity of condensed water generated until laundry reaches target dryness on a per laundry quantity basis.

On the other hand, if the flow rate data measured by the flow rate sensing device 65 is the generation quantity of condensed water per unit time, the reference value may be data regarding the generation quantity of condensed water per unit time on a per laundry quantity basis.

Figure 6:
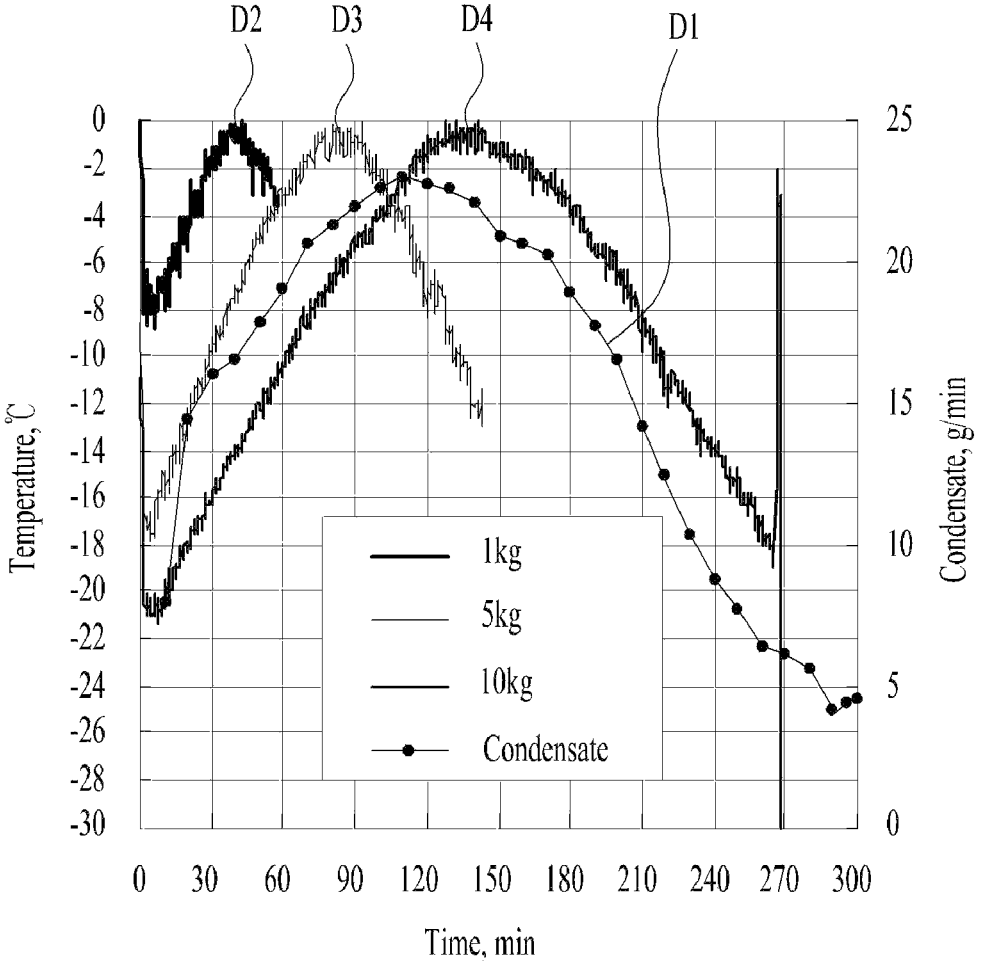
FIG. 6 is a graph showing results of measuring the temperature of air passed through an evaporator and the generation quantity of condensed water per unit time according to the lapse of operation time of the hot air supply unit.

As exemplarily shown by the curve D1 in FIG. 6, at the beginning of the drying cycle, laundry contains a great quantity of moisture and the heat exchanger 45 actively exchanges heat between the air supplied into the tub 2 and the laundry. Therefore, the generation quantity of condensed water per unit time increases for a prescribed time after the drying cycle begins.

However, at the end of the drying cycle, the quantity of moisture contained in the laundry is reduced as the laundry is dried to a prescribed level, and the heat exchanger 45 exhibits less heat exchange between the air supplied into the tub 2 and the laundry. Therefore, the generation quantity of condensed water per unit time is reduced.

Accordingly, if the dryness controller (not shown) or a separate data storage device stores data (reference value) regarding the experimentally measured generation quantity of condensed water per unit time on a per laundry quantity basis, the dryness controller (not shown) may determine current dryness of laundry by comparing data (the generation quantity of condensed water per unit time) provided by the flow rate sensing device 65 with the reference value.

Meanwhile, the dryness controller (not shown) may be provided independently of a main controller (not shown) that controls at least one of the motor 33, the drain unit 27, a water supply unit (not shown) that supplies wash water into the tub 2 and the detergent supply unit 155, and the heat exchanger 45. Alternatively, the main controller (not shown) may implement the above-described function of the dryness controller (not shown).

If the flow rate sensing device 65 simply serves to measure the quantity of condensed water generated in the evaporator 451, the dryness controller (not shown) may calculate the generation quantity of condensed water per unit time by adding up flow rate data, measured and transmitted in real time by the flow rate sensing device, for the unit time.

In this way, if the dryness sensing unit 6 determines that laundry is dried to a prescribed level, the laundry treatment apparatus 100 of the present invention may stop operation of the heat exchanger 45 and the blower 49, thereby terminating the drying cycle.

FIG. 5 is a view showing another embodiment of the dryness sensing unit 6 included in the laundry treatment apparatus 100 of the present invention. The dryness sensing unit 6 according to the present embodiment has a feature in that it further includes a condensed water storage container 63 in which condensed water discharged from the connection duct 43 is stored.

The condensed water storage container 63 may be separated from the connection duct 43 as exemplarily shown in FIG. 5(*a*), or may be coupled to the connection duct 43 as exemplarily shown in FIG. 5(*b*).

In the case of FIG. 5(*a*), the condensed water pipe 61 may be installed to connect the connection duct 43 and the drain unit 27 to each other, or may be installed to communicate the interior of the connection duct 43 with the outside of the cabinet 1. The condensed water storage container 63 provides a space in which condensed water discharged through the condensed water pipe 61 is stored, and is separated from the connection duct 43.

In this case, the flow rate sensing device may include a flow meter which is installed to the condensed water pipe 61 to measure the total quantity of condensed water generated in the evaporator 451 or the generation quantity of condensed water per unit time, or may include a water level sensor 67 which senses the level of condensed water stored in the condensed water storage container 63.

With regard to the water level sensor 67, the condensed water pipe 61 may be provided with a valve 611 to allow condensed water to be temporarily stored in the condensed water storage container 63. The water level sensor 67 may sense the level of condensed water in the condensed water storage container 63 and transmit water level data to the dryness controller (not shown).

Accordingly, the dryness controller (or the aforementioned main controller) may calculate the generation quantity of condensed water per unit time by adding up water level data provided for unit time by the water level sensor 67 while the valve 611 opens or closes the condensed water pipe 61 at a period of unit time.

Alternatively, the dryness controller (not shown) may determine dryness of laundry by simply comparing flow rate data (water level data) provided by the water level sensor 67 with an experimentally determined reference value.

More specifically, the total quantity of condensed water discharged from laundry based on target dryness of laundry on a per laundry quantity basis may be within a prescribed range. Accordingly, if the dryness controller or a separate storage device stores data (reference value) regarding the total quantity of condensed water generated until laundry reaches target dryness on a per laundry quantity basis, the dryness controller (not shown) may determine dryness of laundry by simply sensing the level of condensed water stored in the condensed water storage container 63 (without calculation of the generation quantity of condensed water per unit time).

In the case of FIG. 5(*b*), the condensed water pipe 61 may be installed to connect the connection duct 43 and the drain unit 27 to each other, or may be installed to communicate the interior of the connection duct 43 with the outside of the cabinet 1. The condensed water storage container 63 provides a space in which condensed water discharged through the condensed water pipe 61 is stored and is coupled to the connection duct 43.

More specifically, the condensed water storage container 63 is located below the connection duct 43 to provide a space in which condensed water is stored. In this case, the connection duct 43 has a through-hole 437 perforated in the bottom thereof, and the condensed water storage container 63 communicates with the interior of the connection duct 43 via the through-hole 437.

In this case, the through-hole 437 may be perforated in the bottom of the connection duct 43 at a position below the evaporator 451. Thus, the through-hole 437 may prevent condensed water generated in the evaporator 451 from being moved to the suction duct 41 or the condenser 453.

According to the present invention, the laundry treatment apparatus 100 may further include a temperature sensor (not shown) installed between the evaporator 451 and the condenser 453 to determine dryness of laundry (the quantity of moisture contained in laundry) or a termination time of the drying cycle.

Positioning the temperature sensor (not shown) between the evaporator 451 and the condenser 453 may prevent impurities from being accumulated on the temperature sensor, thereby preventing the temperature sensor from failing to acquire accurate temperature data. Moreover, through this positioning of the temperature sensor (not shown), it is possible to determine dryness of laundry or a termination time of the drying cycle using only one temperature sensor, differently from conventional laundry treatment apparatuses using two or more temperature sensors.

Despite the fact that the filter unit 5 filters air to be introduced into the evaporator 451, impurities contained in the air may be directed to the evaporator 451. Thus, if the temperature sensor (not shown) is located in front of the evaporator 451, there is a risk of the temperature sensor (not shown) failing to sensitively measure the temperature of air due to the impurities.

However, as described above, when the temperature sensor (not shown) is located between the evaporator 451 and the condenser 453, the evaporator 451 may serve to filter impurities introduced into the evaporator 451, and thus there is no problem due to impurities accumulated on the temperature sensor (not shown).

Meanwhile, during the drying cycle, the temperature of air measured by the temperature sensor (not shown) located between the evaporator 451 and the condenser 453 reaches the highest value within different durations according to the quantity of laundry, and exhibits different variation after reaching the highest value.

That is, if the quantity of laundry is small (D2), the temperature of air passed through the evaporator 451 reaches the highest value within a relatively short duration and thereafter is gradually lowered (due to deterioration in the efficiency of the heat exchanger 45, the temperature variation rate is less than that in the case in which the quantity of laundry is great). On the other hand, if the quantity of laundry is great (D4), the temperature of air passed through the evaporator 451 requires a relatively long duration to reach the highest value and is rapidly lowered after reaching the highest value (i.e. the temperature variation rate is greater than that in the case in which the quantity of laundry is small).

Accordingly, dryness of laundry during the drying cycle may be determined by comparing a predetermined reference value based on target dryness of laundry on a per laundry quantity basis (i.e. a difference value between the highest temperature and a temperature measured when a reference duration has passed after air reaches the highest temperature) with a value measured by the temperature sensor (not shown) (i.e. a difference value between the highest temperature and a temperature measured when a reference duration has passed after measurement of the highest temperature).

In more detail, after the drying cycle begins (i.e. after the heat exchanger 45 and the blower 49 are operated), the dryness controller (not shown) periodically receives data regarding the temperature of air passed through the evaporator 451 from the temperature sensor (not shown).

The dryness controller (not shown) may determine whether or not the temperature data transmitted from the temperature sensor (not shown) is the highest temperature by determining increase or reduction of the temperature data provided by the temperature sensor (not shown).

If it is determined that the temperature sensor transmits the highest temperature, the dryness controller (not shown) may determine the quantity of laundry by comparing a transmission time of the highest temperature with data regarding a duration required until laundry reaches the highest temperature on a per laundry quantity basis. Then, the dryness controller (not shown) may set data regarding a corresponding laundry quantity, selected from among data regarding "a difference value between the highest temperature and a temperature measured after measurement of the highest temperature" based on target dryness of laundry on a per laundry quantity basis (this data being stored in the dryness controller or a separate data storage device), to the reference value.

Accordingly, the dryness controller (not shown) may determine whether or not laundry reaches target dryness on a per laundry quantity basis by determining whether or not a difference value between the highest temperature and a temperature transmitted after transmission of the highest temperature, transmitted from the temperature sensor (not shown), is equal to the reference value. In this way, the dryness controller (not shown) may decide a termination time of the drying cycle (i.e. a point in time to stop operation of the heat exchanger 45 and the blower 49).

MODE FOR INVENTION

As described above, a related description has sufficiently been discussed in the above "Best Mode" for implementation of the present invention.

INDUSTRIAL APPLICABILITY

As described above, the present invention may be wholly or partially applied to a laundry treatment apparatus.

The invention claimed is:

1. A garment processing apparatus comprising:

a cabinet defining an external appearance of the apparatus, the cabinet having a laundry opening;

a laundry accommodation unit placed within the cabinet and configured to store laundry introduced through the laundry opening;

a hot air supply unit including a circulation path arranged in an upper portion of the laundry accommodation unit so as to guide air discharged from the laundry accommodation unit and resupply the air into the laundry accommodation unit, a heat exchanger installed to the circulation path to implement condensation and heating of the air introduced into the circulation path, and a blower configured to circulate interior air of the laundry accommodation unit through the circulation path; and a drain unit installed to a bottom of the laundry accommodation unit for discharge of wash water stored in the laundry accommodation unit; and a dryness sensing unit including a condensed water pipe installed to connect the circulation path and the drain unit to each other so as to discharge condensed water generated in the heat exchanger to outside of the circulation path, a flow rate sensing device configured to measure a quantity of condensed water generated in the heat exchanger and a controller configured to determine a quantity of moisture contained in laundry based on flow rate data provided by the flow rate sensing device.

2. The apparatus according to claim 1, wherein the controller determines the quantity of moisture contained in the laundry by comparing the quantity of condensed water generated in the heat exchanger per unit time with a predetermined reference value.

3. The apparatus according to claim 1, wherein the controller determines the quantity of moisture contained in the laundry by comparing a total quantity of condensed water generated in the heat exchanger with a predetermined reference value.

4. The apparatus according to claim 1, wherein the laundry accommodation unit includes a tub placed within the cabinet and configured to store wash water therein, and a drum rotatably placed within the tub and configured to store the laundry introduced through the laundry opening, and wherein the circulation path is configured such that interior air of the tub is discharged into the circulation path and then is resupplied into the tub.

5. The apparatus according to claim 4, wherein the heat exchanger includes:

an evaporator configured to cool air introduced into the circulation path via evaporation of refrigerant, the evaporator being located in the circulation path;

a condenser configured to heat the air passed through the evaporator via condensation of the refrigerant, the condenser being located in the circulation path; and a compressor installed at the outside of the circulation path to enable circulation of the refrigerant through the evaporator and the condenser.

6. The apparatus according to claim 5, further comprising a wherein the drain unit including includes a drain pump and a drain pipe configured to guide wash water stored in the tub to the drain pump, wherein a condensed water pipe is installed to connect the circulation path and the drain pipe to each other.

7. The apparatus according to claim 6, wherein one end of the condensed water pipe connected to the circulation path is located between the evaporator and the condenser.

8. The apparatus according to claim 5, wherein the circulation path includes:

a suction duct fixed at a rear portion of a circumferential surface of the tub, through which the interior air of the tub is discharged;

a connection duct installed to connect the suction duct and the blower to each other, the evaporator and the condenser being fixed to the connection duct between the suction duct and the blower; and a discharge duct configured to supply the air discharged from the blower into the tub, the discharge duct being fixed to a front surface of the tub facing the laundry opening.

9. The apparatus according to claim 8, wherein the connection duct includes a sump provided below the evaporator such that condensed water generated in the evaporator is stored in the sump, and wherein the condensed water pipe is configured to discharge the condensed water stored in the sump to the outside of the connection duct.

10. The apparatus according to claim 9, wherein the sump is defined by a plurality of support ribs protruding from the connection duct to support the bottom of the evaporator.

11. The apparatus according to claim 8, wherein the dryness sensing unit further includes a condensed water storage container in which the condensed water discharged from the condensed water pipe is stored, and wherein the flow rate sensing device includes a water level sensor configured to measure a level of condensed water stored in the condensed water storage container.

12. The apparatus according to claim 11, wherein the connection duct has a through-hole, through which condensed water generated in the evaporator is discharged to an outside of the connection duct, and wherein the condensed water storage container is coupled to the connection duct to store condensed water discharged from the through-hole.

13. A control method of a garment processing apparatus, the garment processing apparatus comprising a laundry accommodation unit in which laundry is stored, a circulation path arranged in an upper portion of the laundry accommodation unit so as to guide air discharged from the laundry accommodation unit and resupply the air into the laundry accommodation unit, a heat exchanger installed to the circulation path to implement condensation and heating of the air introduced into the circulation path, a blower configured to circulate interior air of the laundry accommodation unit through the circulation path, a drain unit installed to a bottom of the laundry accommodation unit for discharge of wash water stored in the laundry accommodation unit, a condensed water pipe installed to connect the circulation path and the drain unit to each other so as to discharge condensed water generated in the heat exchanger to outside of the circulation path, and a flow rate sensing device configured to measure a quantity of condensed water generated in the heat exchanger, the control method comprising:

operating the heat exchanger and the blower;

measuring the quantity of condensed water generated in the heat exchanger via the flow rate sensing device; and stopping operation of the heat exchanger and the blower based on a result of comparing flow rate data provided by the flow rate sensing device with a predetermined reference value.

14. The control method according to claim 13, wherein stopping operation of the heat exchanger and the blower is conducted when generation quantity of condensed water per unit time, measured by the flow rate sensing device, is equal to or less than the predetermined reference value.

15. The control method according to claim 13, wherein stopping operation of the heat exchanger and the blower is conducted when a total quantity of condensed water generated in the heat exchanger, measured by the flow rate sensing device, is equal to or greater than the predetermined reference value.

* * * * *